US007862387B2

(12) United States Patent
Weber

(10) Patent No.: US 7,862,387 B2
(45) Date of Patent: Jan. 4, 2011

(54) BOARD CONNECTOR MODULE FOR MEZZANINE CIRCUIT BOARD ASSEMBLIES

(75) Inventor: Ron Christian Weber, Vught (NL)

(73) Assignee: FCI, Versailles (FR)

( * ) Notice: Subject to any disclaimer, the term of this patent is extended or adjusted under 35 U.S.C. 154(b) by 94 days.

(21) Appl. No.: 12/087,449

(22) PCT Filed: Jan. 6, 2006

(86) PCT No.: PCT/EP2006/001689

§ 371 (c)(1),
(2), (4) Date: Jul. 7, 2008

(87) PCT Pub. No.: WO2007/076901

PCT Pub. Date: Jul. 12, 2007

(65) Prior Publication Data

US 2009/0004892 A1 Jan. 1, 2009

(51) Int. Cl.
*H01R 13/502* (2006.01)

(52) U.S. Cl. ..... 439/686

(58) Field of Classification Search ..... 439/686, 439/83, 937, 247–248, 91, 71
See application file for complete search history.

(56) References Cited

U.S. PATENT DOCUMENTS 4,506,215 A * 3/1985 Coughlin ..... 324/761
4,609,243 A * 9/1986 Wyss ..... 439/44
4,622,514 A * 11/1986 Lewis ..... 324/761
4,901,013 A * 2/1990 Benedetto et al. ..... 324/761
5,415,556 A * 5/1995 Schroll ..... 439/77
6,404,211 B2 * 6/2002 Hamel et al. ..... 324/754
6,417,684 B1 * 7/2002 Schmid et al. ..... 324/761
6,424,164 B1 * 7/2002 Kister ..... 324/754
6,530,148 B1 * 3/2003 Kister ..... 29/842
6,595,788 B2 * 7/2003 Harper et al. ..... 439/83
7,271,602 B2 * 9/2007 Tunaboylu et al. ..... 324/754
2004/0171310 A1 9/2004 Harper, Jr. et al. ..... 439/686

FOREIGN PATENT DOCUMENTS

EP 0 582 264 A1 2/1994
JP 63-266787 11/1988

OTHER PUBLICATIONS

"High Density Parallel Board", © IBM Corp., 1991, XP-000282537, pp. 160-163.

* cited by examiner

*Primary Examiner*—Jean F Duverne
(74) *Attorney, Agent, or Firm*—Harrington & Smith

(57) ABSTRACT

The invention relates to a board connector module including a frame accommodating an array of substantially-parallel signal leads (S) and ground leads (G) extending in a longitudinal direction (L). The said frame includes edges extending substantially parallel to said leads and one or more transverse bars extending between said edges. The transverse bars of the frame may resist deflection or buckling of these leads and consequently allow for higher stack heights in mezzanine circuit board assemblies.

21 Claims, 5 Drawing Sheets

BOARD CONNECTOR MODULE FOR MEZZANINE CIRCUIT BOARD ASSEMBLIES

FIELD OF THE INVENTION

Generally, the invention relates to the field of electrical connectors. Specifically, the invention relates to a high speed board connector module and a board connector comprising a plurality of such board connector modules for connecting a counterpart to a circuit board or card. In particular, the invention relates to the board connector module and board connector for a mezzanine circuit board assembly.

BACKGROUND OF THE INVENTION

It is known to mount, in a circuit board assembly, a mezzanine card in a parallel fashion on a baseboard and to provide a signal interconnection between at least one electronic device on the baseboard and at least one electronic device on the mezzanine card.

There exists a need for increased flexibility in providing interconnection between a baseboard and one or more mezzanine cards. In particular, there exists a need for enabling a larger distance between the base board and the mezzanine card (stack height). This may be problematic as prior art board connectors typically only have a limited height, since beyond a certain limited length the signal and ground leads of these connectors would deflect or buckle during inserting these board connectors in corresponding circuit boards. In particular for board connectors with press-fit terminals, the insertion force for a board connector into the board may be significant.

The increase in the distance between a base board and a mezzanine card in a mezzanine circuit board assembly requires higher board connectors with higher frames. Consequently, deflection or buckling of the signal and ground leads is more likely to occur during application of an insertion force.

SUMMARY OF THE INVENTION

It is an object of the invention to provide a board connector module and a board connector comprising a plurality of these modules that allow for an increased distance between the base board and the mezzanine board in a mezzanine board assembly.

This object is accomplished by a board connector module comprising a frame accommodating an array of substantially parallel signal leads and ground leads extending in a longitudinal direction, wherein said frame comprises edges extending substantially parallel to said leads and one or more transverse bars extending between said edges.

The risk of buckling of the leads exists especially in case of relatively long leads where the insertion force is transferred near the proximal ends of the leads, i.e. the ends of the leads not inserted into a circuit board. The transverse bars of the frame may resist deflection or buckling of these leads and consequently allow for higher stack heights in mezzanine circuit board assemblies. They link the leads together, and limit or avoid buckling of one or more of the leads.

In an embodiment of the invention, the leads of the board connector module have a length in the longitudinal direction in a range between 10-60 mm, preferably 15-40 mm, allowing for an increased distance between a base board and a mezzanine card in a mezzanine circuit board assembly.

The embodiments of the invention as defined in claims 3,4 and 7 provides the advantage that air forms a better dielectric medium than plastic. As the leads of the board connector module are preferably separated by air as a dielectric medium, there exists a delicate balance between the amount of metal, air and plastic at each point of the board connector module to match the appropriate impedance along the leads. A high amount of plastic at a particular location is usually compensated by a reduced amount of metal. Accordingly, an essentially open frame allows for metal leads of a constant width. Moreover, a reduction of the amount of plastic material reduces the weight of the board connector module.

The embodiment of the invention as defined in claim 5 has the advantage that the substantially equidistant transverse bars in the longitudinal direction provide enhanced buckling resistance along the leads.

The embodiment of the invention as defined in claim 6 has the advantage of proven technology board connection terminals, whereas the required insertion force for these press-fit terminals does not limit, thanks to the invention, the height of the board connector or board connector module.

The embodiment of the invention as defined in claim 8 has the advantage of maintaining a constant impedance between mutual pairs of leads. The presence of the transverse bars over portions of the leads influences the local impedance, which influence can be compensated by altering the dimensions of the leads with respect to the portions of the leads where the impedance is not influenced by the transverse bars.

The embodiments of the invention as defined in claim 9 and 10 have the advantageous effect that by deliberately introducing a predefined force transfer structure on the leads, a reliable and predictable zone is obtained where the insertion force transfers from the force application structure to the leads. Consequently, deformation of the frame may be reduced, in particular when the force application structure directly interacts with the structure on the leads. As a result, higher board connector modules can be manufactured and applied on a circuit board allowing an increased distance between a base board and a mezzanine card in a mezzanine circuit board assembly.

The embodiment of the invention as defined in claim 11 has the advantage that the uniform width of the air gap between the transfer structures improves impedance matching within the signal lead pairs.

The embodiment of the invention as defined in claim 12 has the advantage that when such modules are placed adjacently in a board connector housing, the projections of adjacent modules may abut each other or leave only a small gap in between. Further, the projections may abut the inner walls of the housing. Buckling of the leads may then be further minimized by interaction of the projections with each other and/or with the inner walls of the housing of the board connector.

In another aspect of the invention, a board connector module is provided comprising a frame accommodating an array of substantially parallel signal leads and ground leads extending in a longitudinal direction between board connection terminals capable of contacting a circuit board and mating terminals. The frame comprises edges extending substantially parallel to outer leads of said leads and one or more transverse bars extending between said edges substantially perpendicularly to said longitudinal direction and substantially parallel to the plane of said leads on both sides of said leads.

In still another aspect of the invention, a board connector module is provided comprising a frame accommodating an array of substantially parallel signal leads and ground leads extending in a longitudinal direction. The frame comprises edges extending substantially parallel to outer leads of said leads and one or more transverse bars extending between said edges substantially perpendicularly to said longitudinal direction and substantially parallel to the plane of said leads on both sides of said leads. The transverse bars comprise projections extending in a direction substantially perpendicular to said plane of said leads.

In yet another aspect of the invention, a board connector module is provided comprising a frame accommodating an array of substantially parallel signal leads and ground leads extending in a longitudinal direction extending in a longitudinal direction between press-fit board connection terminals for contacting a circuit board and mating terminals. The frame comprises edges extending substantially parallel to outer leads of said leads and one or more transverse bars extending between said edges substantially perpendicularly to said longitudinal direction and substantially parallel to the plane of said leads on both sides of said leads. The transverse bars comprise projections extending in a direction substantially perpendicular to said plane of said leads.

The board connector modules according to the above-described aspect allow for board connectors for mezzanine applications with an increased stack height.

The invention further provides a board connector comprising a housing accommodating a plurality of substantially parallel arranged board connector modules as discussed above.

Such a board connector can be applied in mezzanine circuit board assemblies with an increased stack height.

Preferably, the frames of the board connector modules comprise holding structures capable of interacting with corresponding complementary structures of a housing of a board connector.

The embodiments of the invention as defined in claims 19 and 20 have the advantage that when the modules are placed adjacently in a board connector housing, the projections of adjacent modules may abut each other or leave only a small gap in between. Further, the projections may abut the inner walls of the housing. Buckling of the leads may then be further minimized by interaction of the projections with each other and/or with the inner walls of the housing of the board connector.

The invention further provides a mezzanine circuit board assembly comprising a first circuit board and a substantially parallel second circuit board, wherein at least one of said circuit boards comprises a board connector as described above with one or more board connector modules as described above.

Preferably, the first circuit board and second circuit board are provided at a distance in a range between 10-60 mm, preferably 14-45 mm, more preferably 14-30 mm. This range comprises distances between the base board and the mezzanine card considerably larger than in prior art mezzanine circuit board assemblies.

The invention will be further illustrated with reference to the attached drawings, which schematically show a preferred embodiment according to the invention. It will be understood that the invention is not in any way restricted to this specific and preferred embodiment.

DETAILED DESCRIPTION OF THE DRAWINGS

Figure 1:
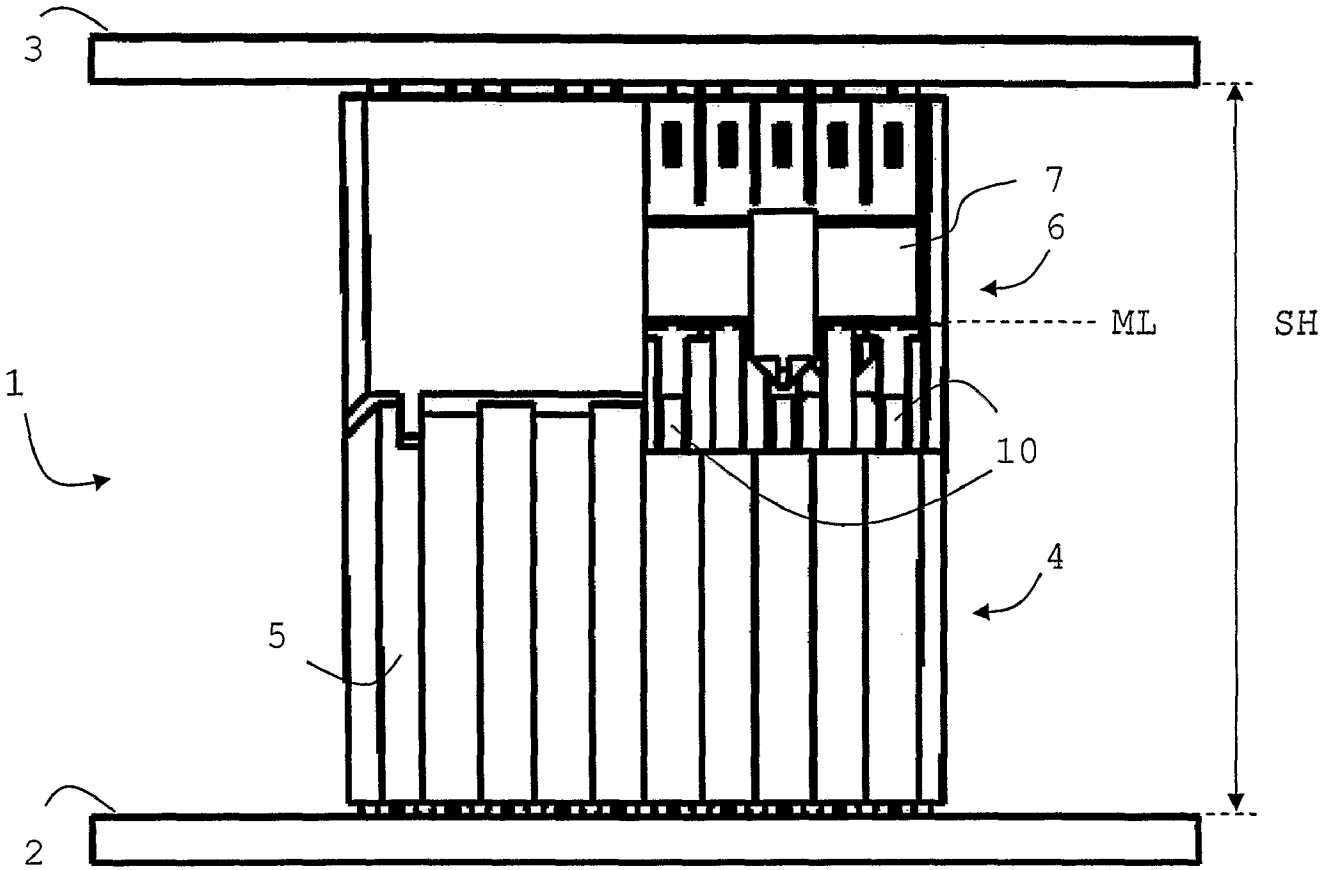
FIG. 1 depicts a partially cutaway view of a mezzanine circuit board assembly according to an embodiment of the invention.

FIG. 1 depicts a partially cutaway view of a mezzanine circuit board assembly 1 according to an embodiment of the invention. The assembly 1 comprises a first circuit board or base board 2 and a second circuit board or mezzanine card 3 arranged at a distance of 14-30 mm (stack height SH). The base board 2 and mezzanine card 3 may comprise several electronic components and circuit traces not shown in FIG. 1.

A board connector 4, hereinafter also referred to as header 4, is inserted into the base board 2. The board connector 4 comprises a housing 5 with a plurality of board connector modules 10 that will be described in further detail with reference to FIGS. 2A-2C.

The mezzanine card 3 has a receptacle 6 configured to establish an electrical contact with the header 4 to allow signal transmission between the base board 2 and the mezzanine card 3. The receptacle has a housing 7.

The mating level ML is provided in a range of 5.5-21.5 mm.

The board connector modules 10 and board connector 4 are a high speed board connectors enabling signal transfer in excess of 1 Gbit/s, preferably in excess of 2 Gbit/s, such as 10 Gbit/s or higher.

Figure 2B:
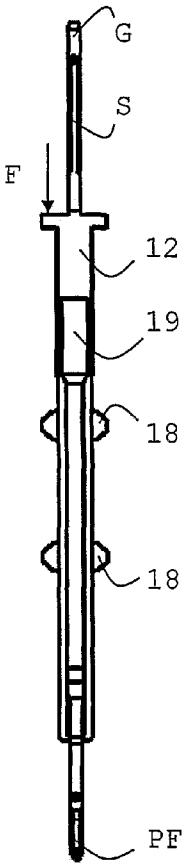
FIGS. 2A-2C show a board connector module according to an embodiment of the invention for the mezzanine circuit board assembly of FIG. 1.
Figure 2A:
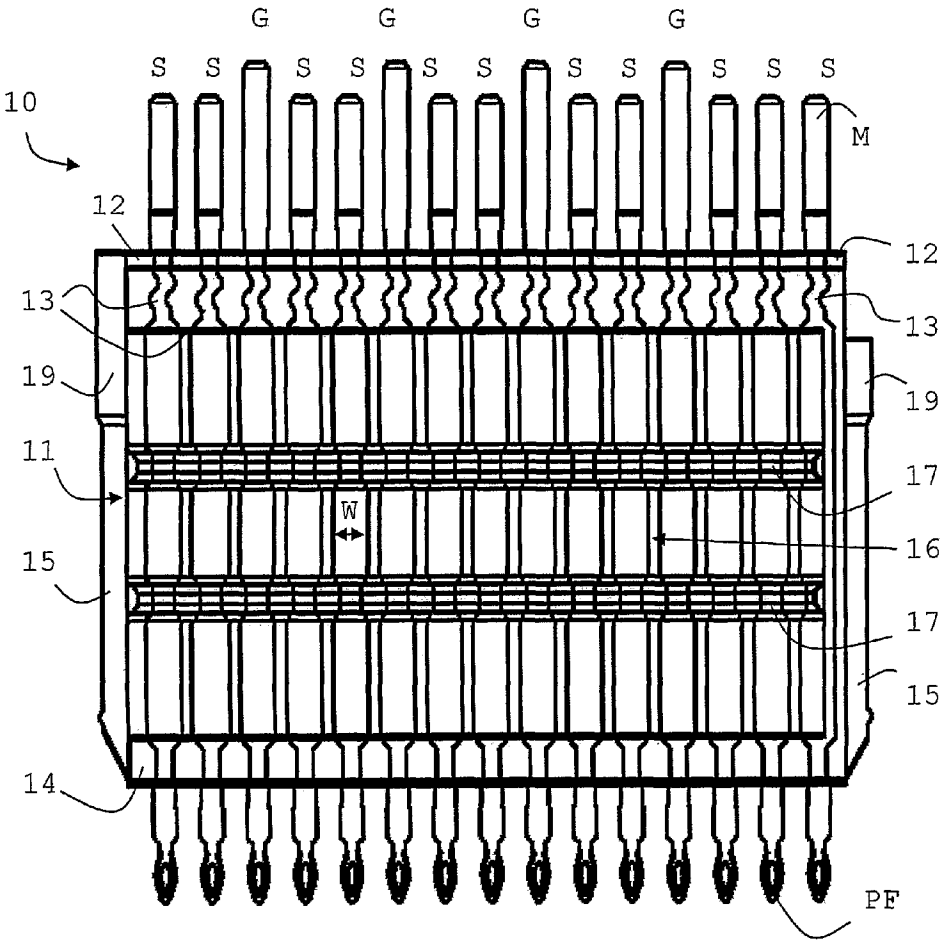
Figure 2C:
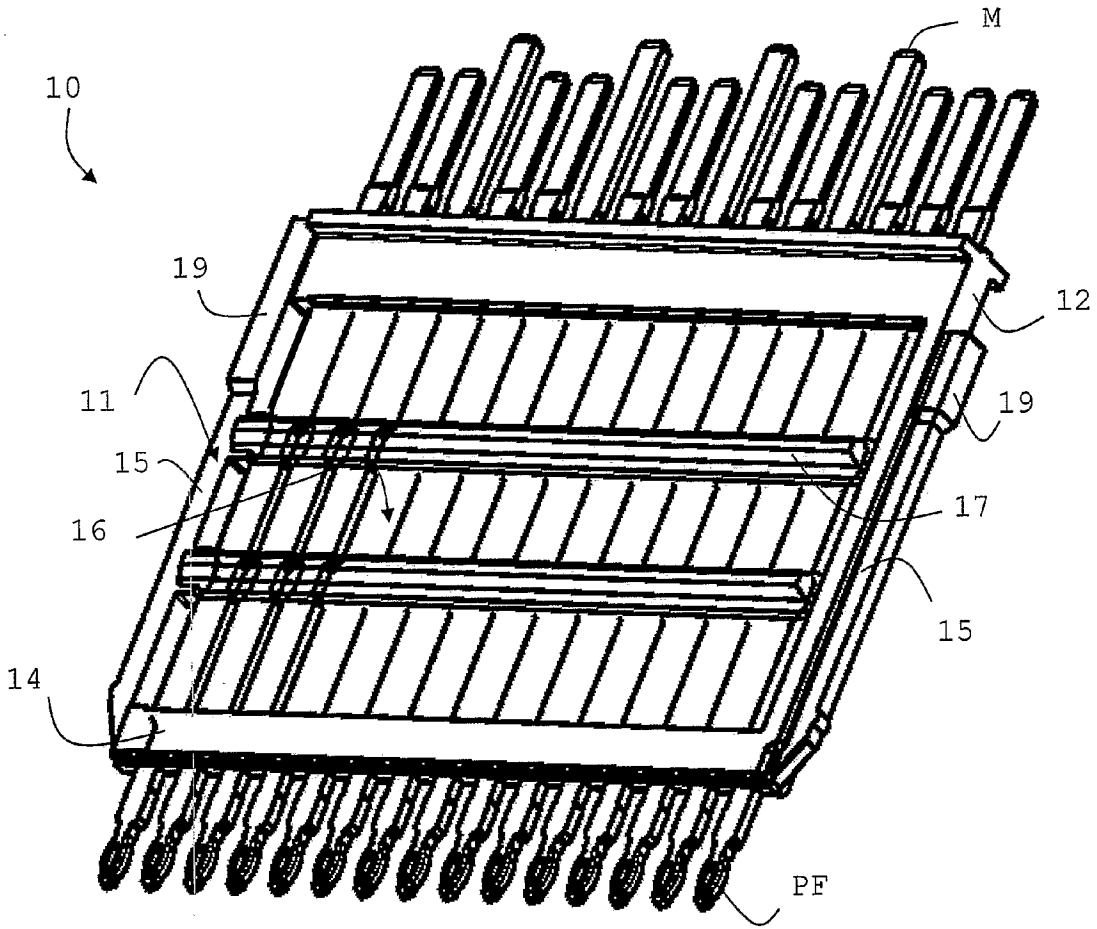

FIGS. 2A-2C show a board connector module 10 in front view, in side view and in perspective view respectively.

The board connector module 10 has a frame 11 accommodating an array of substantially parallel signal leads S and ground leads G extending in a longitudinal direction L in a planar fashion. The leads S, G extend substantially vertical between mating terminals M and press-fit board connection terminals PF. However, it should be appreciated that the invention may be useful for other types of terminals as well. For example, for terminals (e.g. pin-in-paste terminals) inserted in substrates by automatic placing machines that may result in overpressing of one or more leads. The frame 11 comprises a force application bar 12 for inserting the board connector module 10 into the base board 2 by application of a force F in the longitudinal direction L. The leads S,G comprise a predefined force transfer zone 13 structured to transfer the force F applied on the force application bar 12 to the leads S,G.

The leads S, G are separated by air as a dielectric medium. The leads S,G have a length in the range of 10-60 mm, such as 25 mm.

The frame 11 is a plastic frame manufactured e.g. of liquid crystal polymers (LCP's). Apart from the force application bar 12, the frame 11 further comprises a lower bar 14 parallel to said force application bar 12 retaining the leads S,G. The frame 11 further has edges 15 extending between said force application bar 12 and said lower bar 14 in a direction substantially parallel to the longitudinal direction L in the plane of the leads S,G. The force application bar 12, lower bar 14 and edges 15 define a frame space 16 that is essentially open apart from transverse bars 17 that will be discussed in detail below.

The air separation of the leads S,G and the substantially open frame space 16 provide an improved dielectric medium of air instead of plastic. It should be noted, however, that plastic, such as LCP's may be used as a dielectric medium as well.

The force application bar 12 tightly fits with the predefined force transfer structure 13 facilitating and making more reliable the transfer of a force from the force application bar 12 to the leads S,G at the transfer structure 13 location. The force application bar 12 is provided near the mating terminals M of the leads S, G such that the force application bar 12 is easily accessible for a pressing tool.

The force application bar 12 has a T-shape arranged such that the horizontal part is available for application of the force F, whereas the vertical leg is molded over the force transfer structure 13 to establish a tight shape fit.

The force transfer structures 13 have an undulating structure or cobra-shaped structure, in particular for a better fixing in the application bar 12. Embedded in plastics, such structures prevents the application bar from sliding along the leads S, G. It should be appreciated that alternative shapes for these force transfer structures can be envisaged wherein the cross-section of the leads and the distance between adjacent leads remains substantially constant. The force transfer structures 13 have a reduced width as compared to the width W of the leads S,G in the free frame space 16 for impedance matching between lead pairs inside the plastic frame. Further, the force transfer structures 13 are shaped such that the air gap between transfer structures 13 of adjacent leads S,G in the frame 11 has a substantially uniform width.

The transverse bars 17 of the frame 11 extend between the edges 15 and cross the open frame space 16. Since the insertion force F is transferred to the leads S,G already at the force transfer structures 13, these transverse bars 17 act as a barrier against buckling of the leads S,G. The transverse bars are shown being transparent in FIG. 2A and partly transparent in FIG. 2C to show that the leads S,G are undercut, i.e. have a reduced width, at these bars 17 location, to compensate for the presence of the plastic of the bars 17 in view of the impedance matching considerations mentioned above. The transverse bars 17 are located on the edges 15 in the longitudinal direction L such that the frame space 16 is divided in substantially equal portions. It is noted that the number of transverse bars depends e.g. on the height of the board connector module 10 and the thickness of the leads S,G. A board connector module of 15 mm may e.g. have one transverse bar 17, whereas a board connector module of 40 mm may e.g. have two, three or four transverse bars. A board connector module of 15 mm with thick leads S,G may even require no bar, whereas a board connector module 10 of this height with very thin leads S,G may require a transverse bar 17.

It should further be appreciated that other anti-deflection structures 17 to prevent buckling of the leads have been envisaged, such as bars that cross the frame space 16 in a diagonal fashion.

In the embodiment shown, the transverse bars 17 have projections 18 extending in a direction substantially perpendicularly to the plane of the leads S,G. The function of these projections 18 will be discussed further with reference to FIG. 3.

Finally, the frame 11 has holding structures 19 adapted to cooperate with complementary structures in the housing 5 of the header 4.

Figure 3:
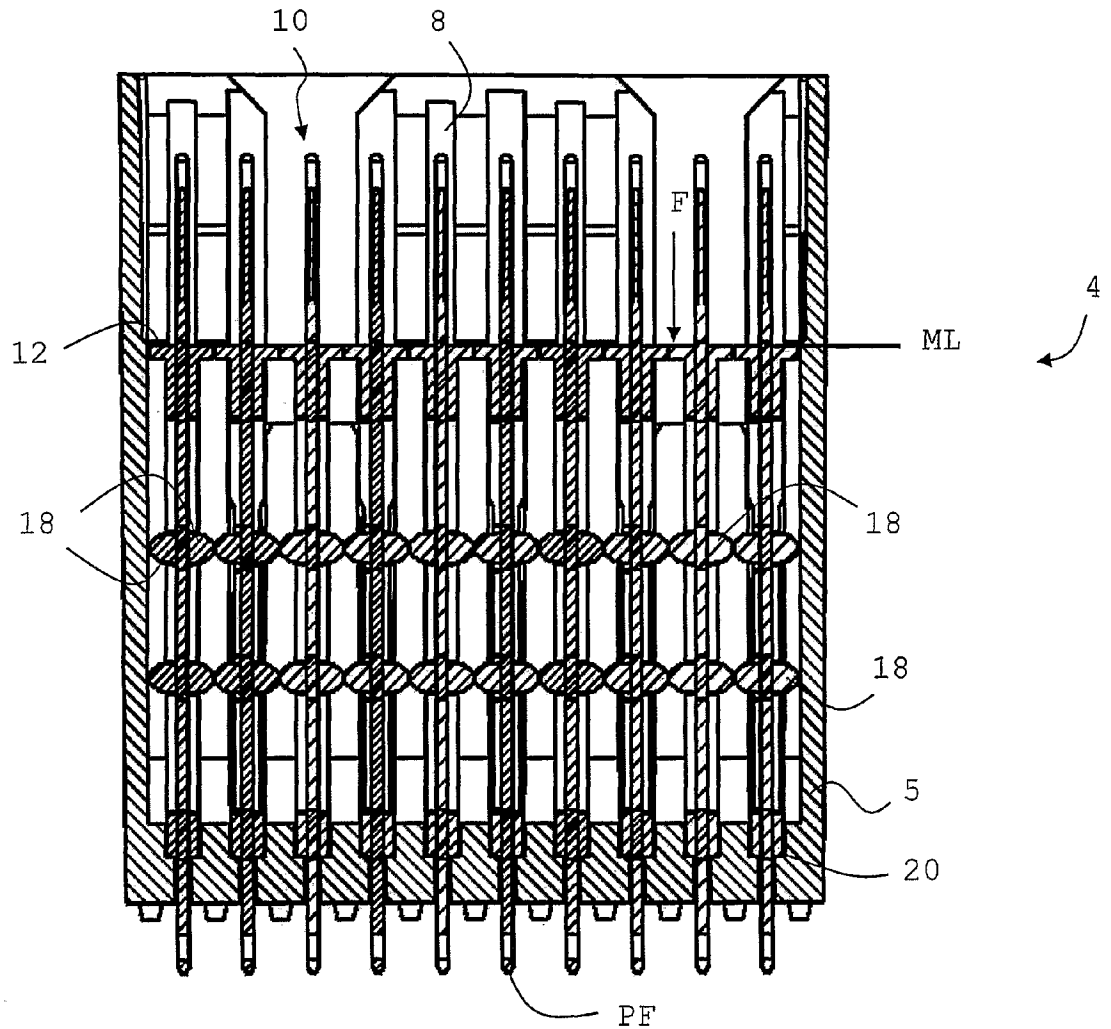
FIG. 3 shows a board connector in cross-section according to an embodiment of the invention with a plurality of board connector modules as shown in FIGS. 2A-2C, and FIGS. 4A and 4B schematically illustrate leads with interrupted transverse bars.

FIG. 3 shows a board connector 4 in cross-section with a plurality of board connector modules 10 as shown in FIGS. 2A-C in a housing 5.

The holding structures 19 of the modules 10 cooperate with complementary structures 8 of the housing 5 for guiding and retaining the modules 10. The holding structures 19 and complementary structures 8 may also function as polarization features. The housing 5 further has receiving structures or stops 20 for receiving the lower bars 14 of the frames 11 of the respective modules 10. The arrangement of the modules 10 is such that the T-shaped force application structures 12 are all positioned at the same height in the longitudinal direction such that the horizontal parts abut. As shown, the T-shaped force application structures 12 are easily accessible for application of an insertion force F to insert the press-fit board connection terminals PF into the base board 2 by a press tool (not shown).

Clearly, the projections 18 of the transverse bars 17 of adjacent modules 10 abut. As shown, the projections 18 of the outer modules 10 abut to the inner surface of the housing 5. If a lead S,G of a board connector module 10 deflects sideways, which is perpendicularly to the plane of leads S,G of a board connector module 10, on application of a force, e.g. the insertion force F, the abutting projections 18 of adjacent modules 10 resist the deflection of the leads. It should be appreciated, however, that the board connector module 10 according to the invention does not necessarily have such projections 18. It should further be noted that modules 10 with and without projections 18 may e.g. be alternately inserted in the housing 5 of the header 4, wherein the projection 18 of a first board connector module 10 abuts with the transverse bar of an adjacent second board connector module 10. Further, it should be appreciated that the projections 18 not necessarily abut but may leave a small gap in between.

Finally, it should be appreciated that the transverse bars 17 are not necessarily continuous bars, i.e. bars connecting the edges 15 without being interrupted. Instead the transverse bars 17 may be interrupted, as schematically illustrated in FIGS. 4A and 4B.

Figure 4B:
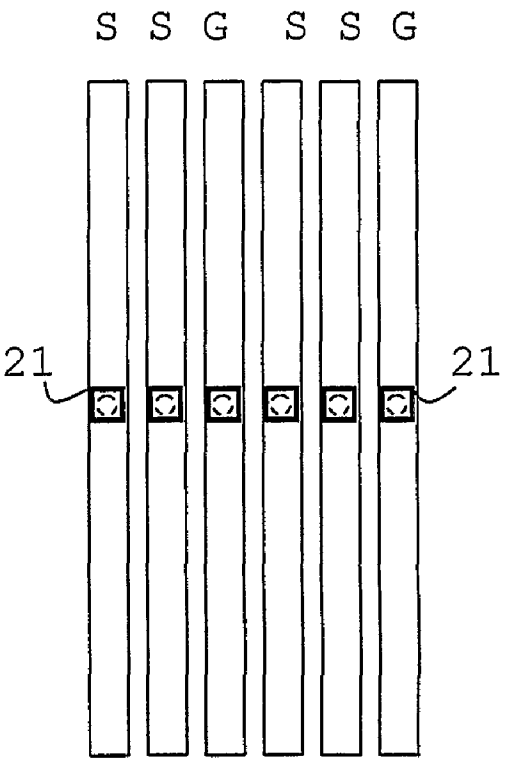
Figure 4A:
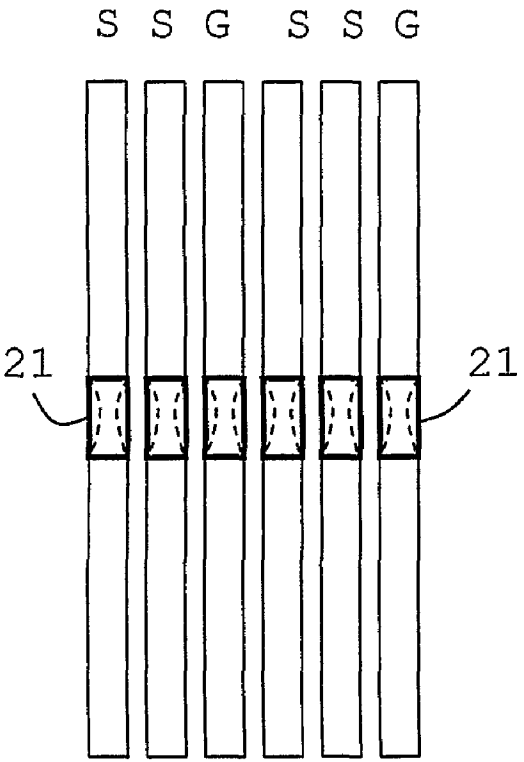

FIGS. 4A and 4B schematically illustrate leads S,G and transverse bars 17 of a board connector module.

In FIG. 4A, a transverse bar piece 21 (shown by the bold line) is mounted on each of the undercut sections (shown by dashed lines) of the leads S,G. The transverse bars pieces 21 together form an interrupted transverse bar 17. The transverse bar pieces 21 have projections 18 (not shown) that may abut with or have a small gap with the projections of a, possibly interrupted, transverse bar 17 of an adjacent board connector module 17.

In FIG. 4B, the leads S,G are not undercut but have a small hole (shown by the dashed circles) on which a transverse bar piece 21 (shown by the bold line) is mounted. The transverse bars pieces 21 together form an interrupted transverse bar 17. Again, the transverse bar pieces 21 have projections 18 (not shown) that may abut with or have a small gap with the projections of a, possibly interrupted, transverse bar 17 of an adjacent board connector module 17.

The invention claimed is:

1. A board connector module comprising a frame accommodating an array of substantially parallel leads (S,G) extending in a longitudinal direction (L), wherein said frame comprises an upper bar, connected by edges extending substantially parallel to said leads, to a lower bar, wherein said frame further comprises one or more transverse bars extending between said edges, wherein said upper bar comprises force application bar, wherein said force application bar, said lower bar and said edges define a space that is essentially open apart from said transverse bars extending between said edges substantially parallel to said force application bar, and wherein said transverse bars provide means for resisting buckling of the leads between said upper and lower bars.

2. The board connector module according to claim 1, wherein said leads have a length in said longitudinal direction in a range between 10-60 mm, preferably 14-30 mm.

3. The board connector module according to claim 1, wherein said frame is an essentially open frame.

4. The board connector module according to claim 1, wherein said frame comprises two or more transverse bars dividing said space in substantially equal portions.

5. The board connector module according to claim 1, wherein said leads comprise press-fit board connection terminals (PF) for insertion in a circuit board on application of a force (F) in said longitudinal direction.

6. The board connector module according to claim 1, wherein said leads (S,G) are separated by an air gap or another dielectric medium in said frame.

7. The board connector module according to claim 1, further comprising means for compensating for local impedance influences caused by the transverse bars over the leads, wherein the means for compensating comprises one or more of said leads having a reduced width covered by said transverse bars.

8. The board connector module according to claim 1, wherein said frame comprises a force application structure extending between said edges for inserting said board connector module into a board and wherein one or more of said leads comprise a predefined force transfer zone structured to transfer a force (P) applied on said force application structure to said leads.

9. The board connector module according to claim 8, wherein said force application structure comprises said upper bar as a force application bar for inserting said board connector module into a board, said force application bar extending substantially transverse to said longitudinal direction substantially parallel to the plane of said leads and being located at a height in said longitudinal direction substantially at said predefined force transfer zone.

10. The board connector module according to claim 8, wherein said leads (S,G) are separated by a gap filled with air or another dielectric medium in said frame and said predefined force transfer zone of each lead comprises a transfer structure shaped such that said air gap between transfer structures of adjacent leads in said frame has a substantially uniform width.

11. The board connector module according to claim 1, wherein said transverse bars comprise projections extending in a direction substantially perpendicularly to said plane of said leads, wherein said projections are adapted to contact adjacent projections of another board connector module in an assembly.

12. A board connector comprising a housing accommodating a plurality of substantially parallel arranged board connector modules according to claim 1.

13. The board connector according to claim 12, wherein said frames of said modules comprise structures capable of interacting with corresponding complementary structures of a housing of a board connector.

14. The board connector according to claim 12, wherein said transverse bars comprise projections extending in a direction substantially perpendicular to said plane of said leads such that projections of transverse bars of a frame of an adjacent board connector module abut with said projections or define a gap with said projections less than 0.1 mm, preferably less than 0.05 mm.

15. The board connector according to claim 12, wherein said transverse bars comprise projections extending in a direction substantially perpendicular to said plane of said leads such that projections of said transverse bars of said frame abut with said housing or define a gap with said housing less than 0.1 mm, preferably less than 0.05 mm.

16. A mezzanine circuit board assembly comprising a first circuit board and a substantially parallel second circuit board, wherein at least one of said circuit boards comprises a board connector according to claim 12.

17. The mezzanine circuit board assembly according to claim 16, wherein said first circuit board and second circuit board are provided at a distance in a range between 10-60 mm, preferably 14-30 mm.

18. The board connector module according to claim 1, wherein said frame comprises an overmolded frame member which is overmolded onto said leads.

19. A board connector module comprising a frame accommodating an array of substantially parallel signal leads (S) and ground leads (G) extending in a longitudinal direction (L) between board connection terminals (PF) capable of contacting a circuit board and mating terminals (M), wherein said frame comprises an upper bar connected to the leads by being molded over the leads and connected to a lower bar by edges extending substantially parallel to outer leads of said leads and one or more transverse bars extending between said edges substantially perpendicularly to said longitudinal direction and substantially parallel to the plane of said leads on both sides of said leads.

20. A board connector module comprising a frame accommodating an array of substantially parallel leads (S,G) extending in a longitudinal direction (L), wherein said frame comprises an upper bar of the frame connected to a lower bar of the frame by edges extending substantially parallel to outer leads of said leads and one or more transverse bars extending between said edges substantially perpendicularly to said longitudinal direction and substantially parallel to the plane of said leads on both sides of said leads and wherein said transverse bars comprise projections extending in a direction substantially perpendicularly to said plane of said leads, wherein said projections are adapted to contact adjacent projections of another board connector module in an assembly.

21. A board connector module comprising a frame accommodating an array of substantially parallel leads (S,G) extending in a longitudinal direction (L) extending in a longitudinal direction (L) between press-fit board connection terminals (PF) for contacting a circuit board and mating terminals (M), wherein said frame comprises an upper bar connected to a lower bar by edges extending substantially parallel to outer leads of said leads and one or more transverse bars extending between said edges substantially perpendicularly to said longitudinal direction and substantially parallel to the plane of said leads on both sides of said leads and wherein said transverse bars comprise projections extending in a direction substantially perpendicularly to said plane of said leads.

* * * * *

UNITED STATES PATENT AND TRADEMARK OFFICE

CERTIFICATE OF CORRECTION

PATENT NO. : 7,862,387 B2
APPLICATION NO. : 12/087449
DATED : January 4, 2011
INVENTOR(S) : Weber It is certified that error appears in the above-identified patent and that said Letters Patent is hereby corrected as shown below:

Claim 8, col. 7, line 22 delete "(P)" and insert --(F)--.

Signed and Sealed this
Fifteenth Day of March, 2011

David J. Kappos

David J. Kappos
*Director of the United States Patent and Trademark Office*